US009010593B2

(12) United States Patent
Tschumi

(10) Patent No.: US 9,010,593 B2
(45) Date of Patent: Apr. 21, 2015

(54) SYSTEM FOR CONNECTING A BRACELET TO A WATCH CASE

(71) Applicant: The Swatch Group Management Services AG, Biel (CH)

(72) Inventor: Philipp Tschumi, Niederwil (CH)

(73) Assignee: The Swatch Group Management Services AG, Biel (CH)

( * ) Notice: Subject to any disclaimer, the term of this patent is extended or adjusted under 35 U.S.C. 154(b) by 0 days.

(21) Appl. No.: 13/942,984

(22) Filed: Jul. 16, 2013

(65) Prior Publication Data

US 2014/0096345 A1 Apr. 10, 2014

(30) Foreign Application Priority Data

Oct. 10, 2012 (EP) ..... 12188013

(51) Int. Cl.
*A44C 5/14* (2006.01)
*G04B 37/14* (2006.01)
*G04B 37/16* (2006.01)

(52) U.S. Cl.
CPC ..... *G04B 37/1486* (2013.01); *Y10T 24/4718* (2015.01); *A44C 5/14* (2013.01); *A44C 5/147* (2013.01); *G04B 37/16* (2013.01)

(58) Field of Classification Search
CPC ..... A44C 5/14; A44C 5/147; A44C 5/16; G04B 37/1486; G04B 37/1493; G04B 37/16; G04G 17/083
USPC ..... 224/164, 168, 177, 180; 368/281, 282; 24/265 WS
See application file for complete search history.

(56) References Cited

U.S. PATENT DOCUMENTS

| | | | | | |
|---|---|---|---|---|---|
| 1,985,249 | A | * | 12/1934 | Feid | 224/174 |
| 2,028,791 | A | * | 1/1936 | Lynds | 224/174 |
| 2,182,830 | A | * | 12/1939 | Vedder | 368/281 |
| 2,747,779 | A | * | 5/1956 | Speck et al. | 224/174 |
| 2,780,400 | A | * | 2/1957 | Lancaster et al. | 224/174 |
| 2,820,275 | A | * | 1/1958 | Lancaster | 24/265 WS |
| 3,581,960 | A | | 6/1971 | Ojima | |
| 2014/0098649 | A1 | * | 4/2014 | Tschumi | 368/282 |

FOREIGN PATENT DOCUMENTS

| | | |
|---|---|---|
| CH | 703 680 B1 | 3/2012 |
| EP | 1 287 758 A1 | 3/2003 |

(Continued)

OTHER PUBLICATIONS

European Search Report issued Mar. 12, 2013, in European Patent Application No. 12188013.2, filed Oct. 10, 2012.

*Primary Examiner* — Justin Larson
*Assistant Examiner* — Scott McNurlen
(74) *Attorney, Agent, or Firm* — Oblon, McClelland, Maier & Neustadt, L.L.P.

(57) ABSTRACT

System for connecting a bracelet to a watch case by means of a link, the watch case comprising a caseband and a back cover, the link comprising a first hollow element and a second element partly nesting in the first hollow element, the first hollow element carrying a first means of fastening to the watch case and the second element carrying a second means of fastening to an adjacent bracelet link, characterized in that the watch case includes a mechanical device arranged to pivot the second element about a transverse axis to the longitudinal direction of the bracelet, the second element transmitting the pivoting motion thereof to the first element which pivots in turn and which is pressed against the caseband of the watch case.

17 Claims, 2 Drawing Sheets

(56) References Cited

FOREIGN PATENT DOCUMENTS

| | | | |
|---|---|---|---|
| EP | 2 319 349 | A1 | 5/2011 |
| FR | 2 713 358 | A1 | 6/1995 |
| JP | 3173930 | U | 2/2012 |

* cited by examiner

SYSTEM FOR CONNECTING A BRACELET TO A WATCH CASE

This application claims priority from European Patent Application No. 12188013.2 filed Oct. 10, 2012, the entire disclosure of which is incorporated herein by reference.

FIELD OF THE INVENTION

The present invention concerns a system for connecting a bracelet or strap to a watch case including external elements made of a hard material such as a ceramic. More specifically, the present invention concerns a link arranged to connect a bracelet or strap to a watch case, said link comprising a first hollow element and a second element nesting in the first element, the first hollow element carrying a first means of fastening to the case and the second element carrying a second means of fastening to an adjacent link of the bracelet.

BACKGROUND OF THE INVENTION

Very generally speaking, the invention concerns the field of watch bracelets made of a hard material such as ceramic material and intended to be assembled to watches whose case includes an exterior made of hard material.

These structures have certain limits as to their application precisely because of the techniques to manufacture them. Indeed, exterior parts made of hard materials, for example ceramic material, are obtained by methods comprising a moulding step followed by a sintering step. During the sintering operation, these parts are subject to shrinkage, i.e. they undergo a significant reduction in volume under the combined action of heat and pressure. This shrinkage may represent more than 30% of the initial volume of the parts. Commonly employed methods can currently produce such parts with tolerances on dimensions of around 0.5 to 1%, since the sintering step makes it difficult to obtain lower tolerances. It may be noted that these tolerances fluctuate according to the batches of raw material used.

By way of example, manufacturing tolerances involved by sintering operations may result in uncertainty of around 0.2 mm over the length of a 3 centimeter ceramic watch case. Given that ceramic watches are in the high end of watchmaking production, such uncertainties are difficult for manufacturers to accept.

To overcome this problem, the most commonly used solution for taking up play between the various ceramic elements used to make the watches consists in carrying out manual machining after the sintering step. However, faced with the increasing demand of clients for ceramic timepieces, manual machining steps have become more and more laborious given the number of timepieces to be treated. Further, manual machining steps are made even more difficult as the complexity of the geometry of the watch cases continues to increase.

It will be noted that the tolerance problem caused by sintering operations becomes more inconvenient the larger the dimensions of the external parts to be manufactured. In particular, these manufacturing tolerances have a detrimental effect on watch cases whose dimensions are generally greater than those of the bracelet links. It will also be clear that the more the manufacturers of ceramic watches wish to make bracelet links of large dimensions, the more difficulty they have in forming satisfactory attractive joins between the watch case and the bracelet or between the bracelet links.

SUMMARY OF THE INVENTION

It is an object of the present invention to overcome the aforementioned drawbacks in addition to others by providing aesthetically enhanced timepieces.

The present invention therefore concerns a system for connecting a bracelet to a watch case by means of a link, the watch case comprising a caseband and a back cover, the link comprising a first hollow element and a second element partly nesting in the first hollow element, the first hollow element carrying a first means of fastening to the watch case and the second element carrying a second means of fastening to an adjacent bracelet link, characterized in that the watch case includes a mechanical device arranged to pivot the second element about a transverse axis to the longitudinal direction of the bracelet, the second element transmitting its pivoting motion to the first element which pivots in turn and which is pressed against the caseband of the watch case.

As a result of these features, the present invention provides a system for connecting a bracelet to a watch case by means of a link which enables the position of the bracelet to be adjusted relative to the watch case. It is therefore possible to overcome the inherent problems of manufacturing tolerances and to obtain an uninterrupted join between the bracelet and the watch case without having to manually finish the external parts, which is advantageous from an aesthetic and economical point of view.

BRIEF DESCRIPTION OF THE DRAWINGS

Other features and advantages of the present invention will appear more clearly from the following detailed description of one embodiment of a link according to the invention, this example being given merely by way of non-limiting illustration with reference to the annexed drawing, in which.

The present invention proceeds from the general inventive idea which consists in providing a system for connecting a bracelet to a watch case by means of a link, said system comprising means which enable the link to be pressed against the watch case. Since it is possible to bring the end link of the bracelet closer to the watch case, any play between the bracelet and the watch case inherent to the sintering manufacturing technique can be compensated for and an uninterrupted join can be obtained between the bracelet and the watch case, which is very advantageous from an aesthetic point of view.

Figure 1:
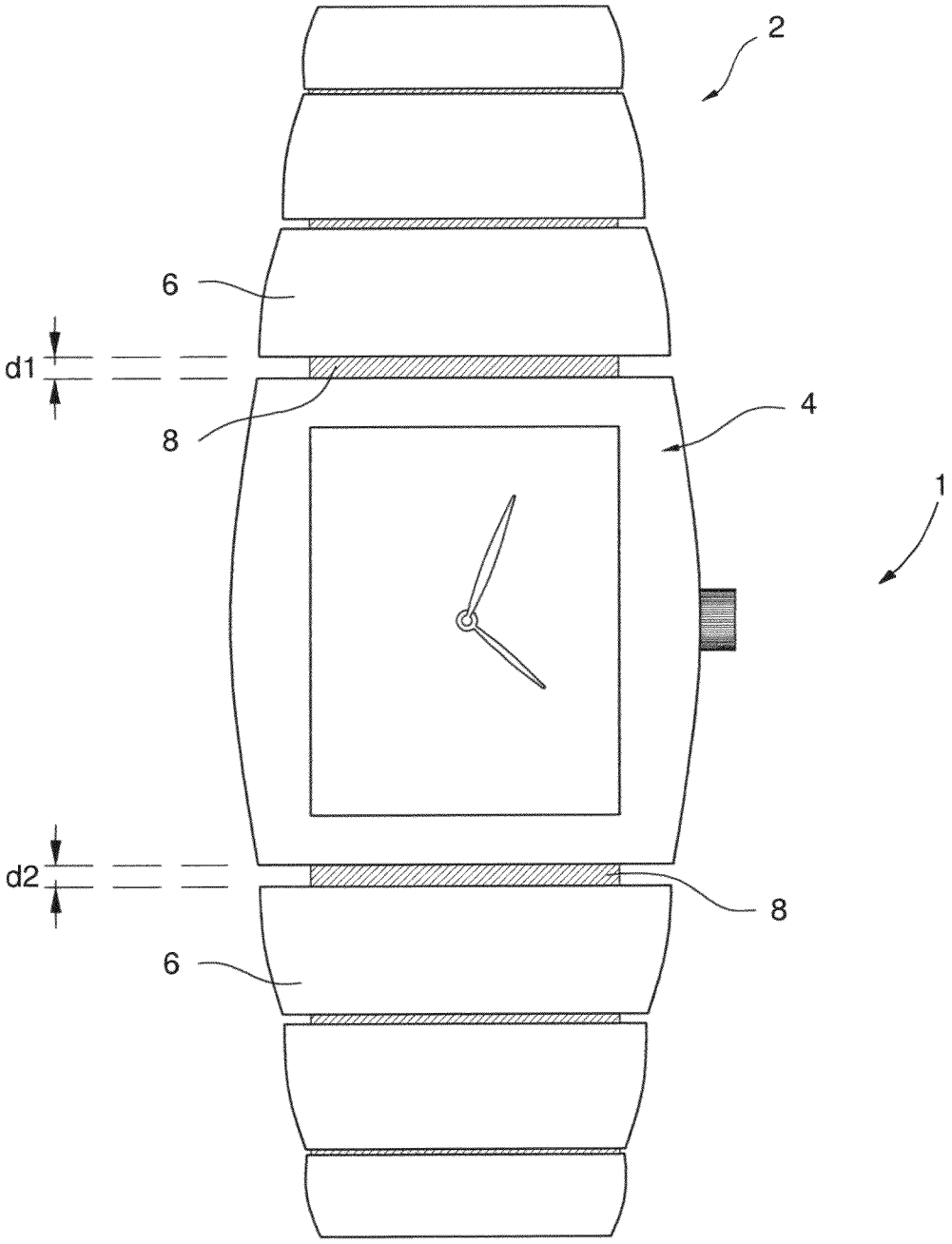
FIG. 1 is a view of a wristwatch according to the prior art.

FIG. 1 shows a wristwatch according to the prior art designed as a whole by the general reference numeral 1. This wristwatch 1 includes a ceramic bracelet 2 connected to a watch case 4 which is also made of ceramic. It is noted in FIG. 1 that, on both sides of watch case 4, there is play, noted d1 and d2, at the join between watch case 4 and the first links 6 of bracelet 2.

As explained in the introductory part of this Patent Application, these plays d1 and d2 occur because of the manufacturing tolerances of watch case 4 and of links 6 of bracelet 2. Indeed, the manufacturing tolerances result in dimensional variations in the various external elements causing discontinuities to appear at the join between bracelet 2 and watch case 4. These discontinuities are unattractive, not least because they reveal the means 8 of fastening bracelet 2 to watch case 4.

The present invention overcomes this problem by providing a link having a particular structure for establishing the play-free mechanical connection between the bracelet and the watch case.

Figure 2:
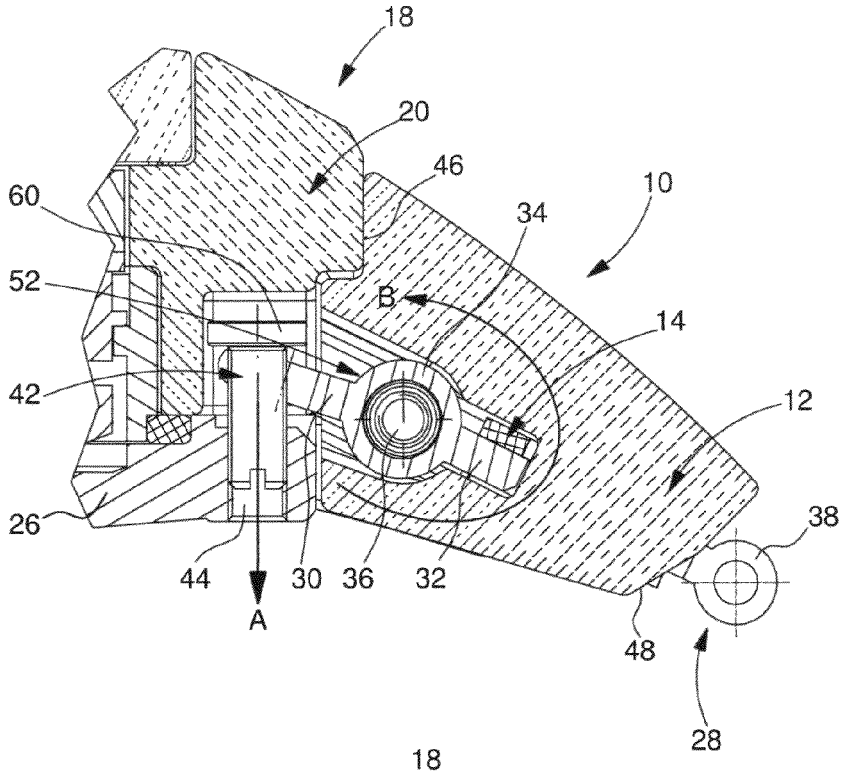
FIG. 2 is a cross-section, along the median axis of the bracelet, of the end link which connects the bracelet to the watch case.
Figure 3:
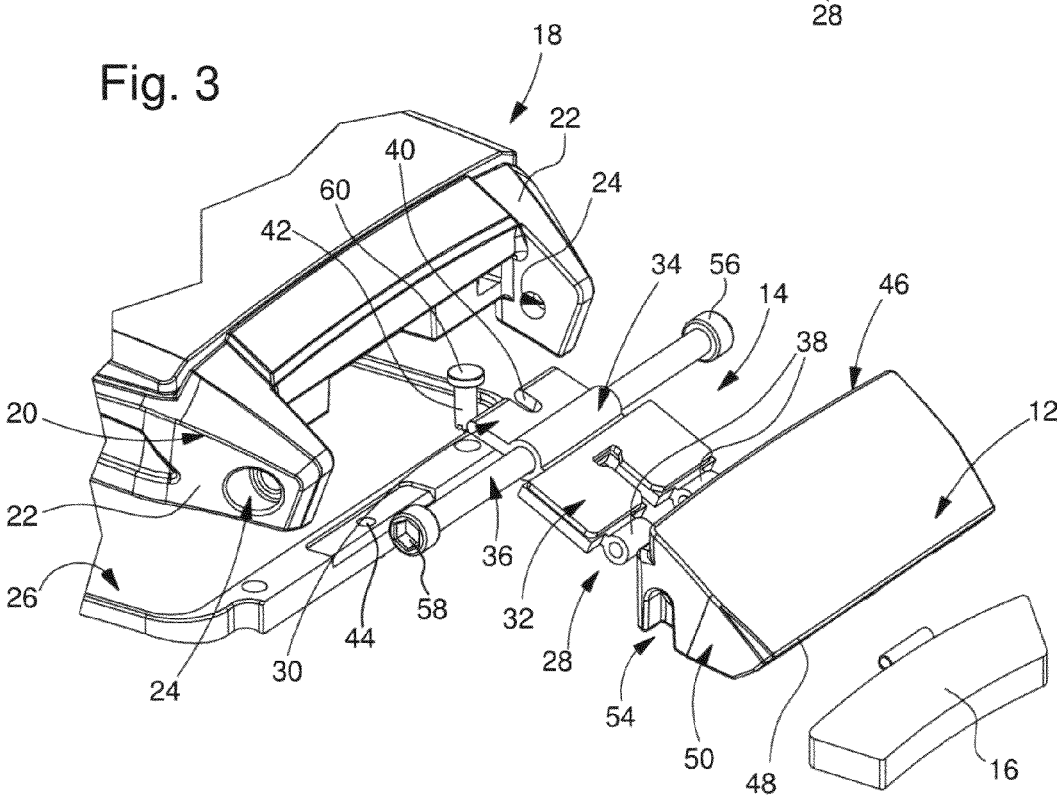
FIG. 3 is an exploded, perspective view of the mechanical device which enables the link arranged to connect the bracelet to the watch case to be moved closer to the watch case.

FIG. 2 is a cross-section, along the median axis of the bracelet, of the end link which enables the bracelet to be connected to the watch case; and FIG. 3 is an exploded perspective view of the mechanical device for moving the link arranged to connect the bracelet to the watch case closer to the watch case.

DETAILED DESCRIPTION OF THE PREFERRED EMBODIMENTS

Designated as a whole by the general reference numeral 10, the link according to the invention includes a first hollow element 12 and a second element 14 partly nesting inside first hollow element 12. Link 10 is provided for connecting a bracelet, whose first link 16 is shown in the drawing, to an external element which at least partially defines a watch case 18. Watch case 18 includes a middle part 20 extended in the longitudinal direction of the bracelet by horns 22 in which a hole 24 is made. Watch case 18 is conventionally delimited on the bottom by a back cover 26.

According to the invention, the first hollow element 12 carries a first means of fastening to the watch case and second element 14 carries a second means of fastening 28 to the adjacent bracelet link 16. More specifically, the second element 14 takes the form of first and second plates, respectively 30 and 32, which are of generally rectangular shape and arranged in the extension of each other, the dimensions of first plate 30 located on the watch case 18 side being slightly smaller than the dimensions of the second plate 32 located on the bracelet side. First and second plates 30 and 32 are connected to each other by a common edge in the form of a hollow cylindrical portion 34 for a fastening pin 36 to pass through, the role of which will be described below. Second plate 32 further includes, along the free edge thereof opposite the common edge via which it is connected to first plate 30, a second ordinary means of fastening to adjacent link 16, such as hinge pins 38 used in conjunction with an ordinary type of bar (not shown). First plate 30 comprises, substantially in the middle of the free edge thereof opposite hollow cylindrical portion 34, a hollow 40 for a mechanical device, such as a threaded stem of an adjusting screw 42, to pass through. This adjusting screw 42 is screwed into a threaded hole 44 which passes right through the back cover 26 of watch case 18.

The first hollow element 12 forms an envelope of substantially trapezoidal cross section delimited by a front face 46, a rear face 48 and two lateral faces 50. A housing 52 is arranged in first hollow element 12 to enable second element 14 to slide inside the envelope. Housing 52 passes right through the first hollow element 12 and, at the front, opens out in the front face 46 side and at the rear, in the rear face 48 side of first hollow element 12. Housing 52 is sized so that the first and second plates 30, 32 project from the first hollow element 12. Finally, the first means of fastening first hollow element 12 to watch case 18 includes a bore 54 which opens out in housing 52 and which is made in lateral faces 50 of first hollow element 12, transversely to the longitudinal direction of the bracelet. This bore 54 is provided for receiving fastening pin 36.

As seen particularly in FIG. 1, the profile of the front face 46 of first hollow element 12 matches the contour of caseband 20 of watch case 18. In order to start assembling link 10 to watch case 18, first of all, adjusting screw 42 is slightly screwed into threaded hole 44 made in back cover 26 of watch case 18. Then, second element 14 is inserted into first hollow element 12 so that the first and second plates 30, 32 project from first hollow element 12. Next, first hollow element 12 is slid between the horns 22 of watch case 18 while ensuring that screw 42 engages in hollow 40 of second element 14. When this assembling step is finished, the holes 24 made in horns 22, bore 54 machined into first hollow element 12 and hollow cylindrical portion 34 are all aligned. To finish the assembly, fastening pin 36 merely has to be passed in succession through hole 24 of one of horns 22, then through bore 54 and hollow cylindrical portion 34 until fastening pin 36 emerges in hole 24 of the other horn 22. To ensure a good coupling between link 10 and watch case 18, fastening pin 36 has, at one end thereof, an increased diameter 56 and at the other end, a threaded hole for screwing in a screw 58 which locks fastening pin 36.

To adjust the position of link 10 with respect to watch case 18 and to compensate for any play between these two elements, the following steps are performed. Adjusting screw 42 is accessible through threaded hole 44 which leads to back cover 26 of watch case 18. Adjusting screw 42 is screwed in so that it moves in translation from top to bottom along arrow A in threaded hole 44. Via the head 60 thereof, adjusting screw 42 presses on first plate 30 of second element 14 so as to pivot said second element 14 anti-clockwise along arrow B. Second element 14, nesting in first hollow element 12, exerts a lever arm on first hollow element 12 under the effect of which first hollow element 12 moves closer to watch case 18. Adjusting screw 42 ceases to be screwed in when the front face 46 of first hollow element 12 matches the contour of caseband 20 of watch case 18. It will be clear that by screwing in adjusting screw 42 farther or less far, the position of first hollow element 12 can be very precisely adjusted with respect to caseband 20 of watch case 18. Moreover, a captive adjustment is obtained.

It goes without saying that this invention is not limited to the embodiment that has just been described and that various simple alterations and variants can be envisaged by those skilled in the art without departing from the scope of the invention as defined by the claims annexed to this Patent Application. In particular, it will be clear that, although described with reference to a bracelet link and a watch case at least partially made of ceramic material, the present invention may be applied in an identical manner to links and to cases made of another hard material, such as steel.

What is claimed is:

1. A system for connecting a bracelet to a watch case with a link, the watch case comprising a caseband and a back cover, wherein the link comprises a first hollow element and a second element partly nesting in the first hollow element, wherein the first hollow element carries a first fastener for fastening to the watch case and the second element carries a second fastener for fastening to an adjacent bracelet link, wherein the watch case includes a mechanical device arranged to pivot the second element about an axis transverse to the longitudinal direction of the bracelet, the second element transmitting the pivoting motion thereof to the first element which pivots in turn and which is pressed against the caseband of the watch case, and wherein the mechanical device includes an adjusting screw arranged to be screwed farther or less far into a threaded hole which passes right through the back cover of the watch case, wherein the adjusting screw comprises a head via which the screw presses on the second element so as to pivot the second element.

2. The system according to claim 1, wherein the second element includes first and second plates connected to each other by a common edge, wherein the first plate comprises, along a free edge thereof opposite the common edge, a hollow in which there is engaged the threaded shank of the adjusting screw, and the second plate comprises, along a free edge thereof opposite the common edge, a fastener for fastening the second plate to the adjacent bracelet link.

3. The system according to claim 2, wherein the first and second plates are connected to each other by a hollow cylindrical portion which forms the common edge and which allows a fastening pin to pass therethrough.

4. The system according to claim 3, wherein the first hollow element forms an envelope delimited by a front face, a rear face and two lateral faces, wherein a housing, inside which the second element slides, is arranged in the first hollow element, wherein the housing passes right through the first hollow element and ends, at the front, in the front face side and at the rear, in the rear face side of the first hollow element, and wherein the housing is sized so that the first and second plates project from the first hollow element.

5. The system according to claim 4, wherein the first fastener for fastening the first hollow element to the watch case includes a bore made transversely to the longitudinal direction of the bracelet in the lateral faces of the first hollow element and which ends in the housing, wherein the bore is arranged to receive a fastening pin.

6. The system according to claim 5, wherein the caseband is extended in the longitudinal direction of the bracelet by horns in which a hole is made and between which the link slides so that the holes made in the horns, the bore machined in the first hollow element and a hollow cylindrical portion are aligned, the fastening pin being passed in succession through the hole in one of the horns, then through the bore and the hollow cylindrical portion until the fastening pin emerges in the hole of the other horn.

7. The system according to claim 6, wherein the fastening pin has, at one end thereof, an increased diameter and, at the other end thereof, a threaded hole for a screw to be screwed into.

8. The system according to claim 2, wherein the first hollow element forms an envelope delimited by a front face, a rear face and two lateral faces, wherein a housing, inside which the second element slides, is arranged in the first hollow element, wherein the housing passes right through the first hollow element and ends, at the front, in the front face side and at the rear, in the rear face side of the first hollow element, and wherein the housing is sized so that the first and second plates project from the first hollow element.

9. The system according to claim 8, wherein the first fastener for fastening the first hollow element to the watch case includes a bore made transversely to the longitudinal direction of the bracelet in the lateral faces of the first hollow element and which ends in the housing, wherein the bore is arranged to receive a fastening pin.

10. The system according to claim 9, wherein the caseband is extended in the longitudinal direction of the bracelet by horns in which a hole is made and between which the link slides so that the holes made in the horns, the bore machined in the first hollow element and a hollow cylindrical portion are aligned, the fastening pin being passed in succession through the hole in one of the horns, then through the bore and the hollow cylindrical portion until the fastening pin emerges in the hole of the other horn.

11. The system according to claim 10, wherein the fastening pin has, at one end thereof, an increased diameter and, at the other end thereof, a threaded hole for a screw to be screwed into.

12. The system according to claim 2, wherein the fastener for fastening the second plate to the adjacent bracelet link includes hinge pins in conjunction with a bar.

13. The system according to claim 12, wherein the first and second plates are connected to each other by a hollow cylindrical portion which forms the common edge and which allows a fastening pin to pass therethrough.

14. The system according to claim 12, wherein the first hollow element forms an envelope delimited by a front face, a rear face and two lateral faces, wherein a housing, inside which the second element slides, is arranged in the first hollow element, wherein the housing passes right through the first hollow element and ends, at the front, in the front face side and at the rear, in the rear face side of the first hollow element, and wherein the housing is sized so that the first and second plates project from the first hollow element.

15. The system according to claim 14, wherein the first fastener for fastening the first hollow element to the watch case includes a bore made transversely to the longitudinal direction of the bracelet in the lateral faces of the first hollow element and which ends in the housing, wherein the bore is arranged to receive a fastening pin.

16. The system according to claim 15, wherein the caseband is extended in the longitudinal direction of the bracelet by horns in which a hole is made and between which the link slides so that the holes made in the horns, the bore machined in the first hollow element and a hollow cylindrical portion are aligned, the fastening pin being passed in succession through the hole in one of the horns, then through the bore and the hollow cylindrical portion until the fastening pin emerges in the hole of the other horn.

17. The system according to claim 16, wherein the fastening pin has, at one end thereof, an increased diameter and, at the other end thereof, a threaded hole for a screw to be screwed into.

* * * * *